US010790131B2

(12) United States Patent
Amirav et al.

(10) Patent No.: US 10,790,131 B2
(45) Date of Patent: Sep. 29, 2020

(54) MASS SPECTROMETER WITH PHOTOIONIZATION ION SOURCE METHOD AND SYSTEM

(71) Applicant: Aviv Amirav, Hod Hasharon (IL)

(72) Inventors: Aviv Amirav, Hod Hasharon (IL); Alexander B. Fialkov, Tel Aviv (IL)

(73) Assignee: AVIV AMIRAV, Hod Hasharon (IL)

( * ) Notice: Subject to any disclaimer, the term of this patent is extended or adjusted under 35 U.S.C. 154(b) by 0 days.

(21) Appl. No.: 16/407,667

(22) Filed: May 9, 2019

(65) Prior Publication Data

US 2019/0348269 A1 Nov. 14, 2019

(30) Foreign Application Priority Data

May 13, 2018 (IL) ..... 259320

(51) Int. Cl.
*H01J 49/16* (2006.01)
*H01J 49/04* (2006.01)
(Continued)

(52) U.S. Cl.
CPC ..... *H01J 49/26* (2013.01); *H01J 27/24* (2013.01); *H01J 49/0422* (2013.01);
(Continued)

(58) Field of Classification Search
CPC ..... H01J 27/24; H01J 49/0422; H01J 49/26; H01J 49/107; H01J 49/162; H01J 49/165; H01J 49/168
See application file for complete search history.

(56) References Cited

U.S. PATENT DOCUMENTS 5,055,677 A * 10/1991 Amirav ..... H01J 49/00 250/282
5,206,594 A * 4/1993 Zipf ..... G01N 27/628 250/423 P (Continued)

OTHER PUBLICATIONS

Soorkia et al, "Airfoil Sampling of a Pulsed Laval Beam with Tunable Vacuum Ultraviolet Synchrotron Ionization Quadrupole Mass Spectrometry: Application to Low-Temperature Kinetics and Product Detection", Review of Scientific Instruments 82, 124102, 2011 (Year: 2011).*

(Continued)

*Primary Examiner* — David E Smith
(74) *Attorney, Agent, or Firm* — Dann Dorfman; Herrell and Skillman, P.C.

(57) ABSTRACT

Method for producing ions for mass spectrometry analysis, including introducing vaporized sample compounds behind a supersonic nozzle and expanding the sample compounds with a carrier gas from the supersonic nozzle into a supersonic nozzle vacuum chamber proximate thereto for vibrationally cooling the sample compounds prior to their ionization. Sample compounds are ionized by either illumination with vacuum ultra-violet photons produced by a continuously operated vacuum ultra-violet photon source or by electrons produced in a fly-through electron ionization ion source; and the ions are transferred to a mass analyzer mounted in a mass analyzer vacuum chamber to obtain mass spectra from vibrationally cold molecules. A quadrupole mass analyzer mounted may be used to obtain mass spectra with dominant molecular ions and fragment ion intensities below 3% of the molecular ion for hydrocarbons. Carrier gas flow rate may exceed 20 ml/min for vibrationally cooling the sample compounds prior to their ionization.

30 Claims, 4 Drawing Sheets

(51) Int. Cl.

| | |
|---|---|
| ***H01J 49/26*** | (2006.01) |
| ***H01J 27/24*** | (2006.01) |
| ***H01J 49/10*** | (2006.01) |

(52) U.S. Cl.
CPC ..... *H01J 49/107* (2013.01); *H01J 49/162* (2013.01); *H01J 49/168* (2013.01)

(56) References Cited

U.S. PATENT DOCUMENTS

| | | | | |
|---|---|---|---|---|
| 6,630,664 | B1 * | 10/2003 | Syage | H01J 49/107 250/288 |
| 10,699,868 | B2 * | 6/2020 | Choi | H01J 37/244 |
| 2009/0101814 | A1 * | 4/2009 | Amirav | H01J 49/0431 250/288 |
| 2011/0036978 | A1 * | 2/2011 | Franzen | H01J 49/0422 250/283 |
| 2012/0085148 | A1 * | 4/2012 | Amirav | G01N 30/30 73/23.39 |
| 2012/0286154 | A1 * | 11/2012 | Zimmermann | G01N 30/12 250/282 |
| 2013/0236362 | A1 * | 9/2013 | Li | H01J 27/024 422/83 |

OTHER PUBLICATIONS

Wang, F.C.Y. et al., "GC×MS of Diesel: A Two-Dimensional Separation Approach", Anal. Chem. 77: 2777-2785 (2005).
Lattimer, R.P. et al., "Field ionization and Field Desorption Mass Spectrometry: Past Present and Future", Anal. Chem. 61, No. 21, 1201A-1215A (1989).
Hejazi, L. et al., "Compatibility of electron ionization and soft ionization methods in gas chromatography/orthogonal time-of-flight mass spectrometry", Rapid Comm Mass Spectrom. 23, 2181-2189 (2009).
Fialkov, A. B. et al., "A New Type of GC-MS with Advanced Capabilities", Int. J. Mass. Spectrom. 251, 47-58 (2006).
Amirav, A. et al., "Gas Chromatography Mass Spectrometry with Supersonic Molecular Beams", J. Mass. Spectrom. 43, 141-163 (2008).
Zimmerman, R. et al., "Photo-ionisation mass spectrometry as detection method for gas chromatography Optical selectivity and multi¬dimensional comprehensive separations", J. Chromatogr. A. 1184, 296-308 (2008).
Amirav, A. et al., "Soft Cold EI—Approaching Molecular Ion Only with Electron Ionization", Rapid. Commun. Mass. Spectrom. 29, 1954-1960 (2015).
Mitschke, S. et al., "Comprehensive Gas Chromatography-Time-of-Flight Mass Spectrometry Using Soft and Selective Photoionization Techniques", Anal. Chem. 78, No. 18, 6364-6375 (2006).
Seeman, B. et al., "Electron Ionization LC-MS with Supersonic Molecular Beams—The New Concept Benefits and Applications", J. Mass. Spectrom. 50, 1252-1263 (2015).

* cited by examiner

Cold PI GC-MS of Diesel Fuel
1.0
2.0
3.0
4.0
5.0
Time, min

Cold PI Flow Injection MS of Diesel Fuel
0.2
0.3
0.4
0.5
0.6
0.7
Time, min

Cold PI Averaged Mass Spectrum of Diesel Fuel
100
200
300
Mass, m/z

MASS SPECTROMETER WITH PHOTOIONIZATION ION SOURCE METHOD AND SYSTEM

FIELD OF THE INVENTION

The invention relates to a mass spectrometer and method using a photoionization ion source.

REFERENCES

Prior art references considered to be relevant as a background to the invention are listed below. Acknowledgement of the references herein is not to be inferred as meaning that these are in any way relevant to the patentability of the invention disclosed herein. Each reference is identified by a number enclosed in square brackets and accordingly the prior art will be referred to throughout the specification by numbers enclosed in square brackets.

[1] F. C. Y. Wang, K. Qian and L. A. Green. "*GC×MS of Diesel: A Two-Dimensional Separation Approach*" Anal. Chem. 77: 2777-2785 (2005).

[2] R. P. Lattimer and H. R. Schulten. "*Field ionization and Field Desorption Mass Spectrometry: Past Present and Future*", Anal. Chem. 61, 1201A-1215A (1989).

[3] L. Hejazi, D. Ebrahimi, D. B. Hibbert and M. Guilhaus, "*Compatibility of electron ionization and soft ionization methods in gas chromatography/orthogonal time-of-flight mass spectrometry*" Rapid Comm Mass Spectrom. 23, 2181-2189 (2009).

[4] A. B. Fialkov, U. Steiner, L. Jones and A. Amirav "*A New Type of GC-MS with Advanced Capabilities*". Int. J. Mass. Spectrom. 251, 47-58 (2006).

[5] A. Amirav, A. Gordin, M. Poliak and A. B. Fialkov "*Gas Chromatography Mass Spectrometry with Supersonic Molecular Beams*" J. Mass. Spectrom. 43, 141-163 (2008).

[6] R. Zimmermann, W. Welthagen and T. Groger. "*Photo-ionisation mass spectrometry as detection method for gas chromatography Optical selectivity and multidimensional comprehensive separations*" J. Chromatogr. A. 1184, 296-308 (2008).

[7] A. Amirav, U. Keshet and A. Danon "*Soft Cold EI—Approaching Molecular Ion Only with Electron Ionization*" Rapid. Commun. Mass. Spectrom. 29, 1954-1960 (2015).

[8] S. Mitschke, W. Welthagen and R. Zimmermann "*Comprehensive Gas Chromatography-Time-of-Flight Mass Spectrometry Using Soft and Selective Photoionization Techniques*" Anal. Chem. 78, 6364-6375 (2006).

[9] B. Seemann, T. Alon, S. Tsizin, A. B. Fialkov and A. Amirav "*Electron Ionization LC-MS with Supersonic Molecular Beams—The New Concept Benefits and Applications*" J. Mass. Spectrom. 50, 1252-1263 (2015).

BACKGROUND OF THE INVENTION

Photoionization is the process of ionization of compounds via their interaction with photons, typically vacuum ultraviolet (VUV) photons that are produced by commercially available Krypton or Deuterium lamps. Photoionization (PI) usually serves for the generation of sample compound ions for their further mass spectrometry analysis. Most popular PI is its form of atmospheric pressure photoionization (APPI) that serves for the detection of liquid chromatography mass spectrometry (LC-MS) while in-vacuum photoionization is sometimes used for the ionization of sample compounds eluting from gas chromatography (GC) columns or that originate from MS probes. While in-vacuum PI is considered a soft ionization method that produces more abundant molecular ions than electron ionization (EI) it was found (as demonstrated below) that it does not provide molecular ions alone and fragment ions are also observed with it. We found and report here for the first time that for large compounds the molecular ion in PI can be weak or even absent, and in general, the larger the sample compounds (in terms of their number of atoms) the weaker are their molecular ions in their PI mass spectra and the degree of molecular ion fragmentation is significantly increased with the sample compound size. It is believed that the reason for this observation is that the larger the compounds, the larger are their internal thermal heat capacities that induce molecular ions fragmentation and also the hotter is the ion source to reduce ion source related peak tailing. Ideally, only molecular ions are required and thus when the gas chromatograph (or liquid chromatograph) is unable to resolve and fully separate mixtures of compounds such as with heavy fuels and oils, the mass spectrometer can provide an averaged mass spectrum of the unseparated mixture in which each compound is shown with its molecular ion isotopomers only, thus enabling mixture characterization via its averaged mass spectrum. Accordingly, when only molecular ions are generated the mass spectrometer alone can serve for mixture separation and separate quantitation. This approach which was tested with field ionization was named by Wang et al. as GC×MS [1]. Currently, the only ionization method that approaches the production of molecular ions alone without fragment ions is field ionization (FI) [1-3]. However, FI is a very weak ionization source, unstable, its response is noticeably reduced every analysis, it requires extensive service, it has non-uniform response that hampers its use for quantitation and it requires special and expensive mass spectrometry instrumentation such as time of flight MS in view of its use of high voltage at the ion source.

Mitschke et al. [8] disclose photoionization of n-nonane ($C_9H_{20}$) in a supersonic molecular beam that was limited to 10 ml/min expansion helium cooling gas that cooled the n-nonane to 200K. The caption alongside FIG. 3*c* of this publication states that thermal fragmentation has vanished and yet it is clear from the figure that a multitude of fragment ions can still be observed with integrated intensity similar to that of the molecular ion. Thus, if after cooling to as low as 200K, fragment ions remain even in a small molecules like n-nonane, this leads to the conclusion that photoionization is of little or no use since if in a mass spectrum of a mixture of compounds one cannot consider every mass spectral peak as a different compound, it cannot serve for characterization of unseparated mixtures which is the goal of mass spectrometry. Furthermore, the fact that cooling in a supersonic molecular beam does not eliminate the fragmentation while the thermal fragmentation is allegedly eliminated appears to imply that the remaining fragmentation is photo-induced fragmentation that is inherent and cannot be eliminated by cooling alone. This suggests that photoionization is like electron ionization where also some fragment ions remain no matter how effective is the cooling in supersonic molecular beams.

BRIEF SUMMARY OF THE INVENTION

It is an object of the present invention to provide an improved method for production of ions for their mass spectrometry analysis and a mass spectrometer system with an improved photoionization ion source.

This object is realized in accordance with the invention by a method and mass spectrometer system having the features of the respective independent claims.

In accordance with one aspect of the invention, there is provided a method for production of ions for their mass spectrometry analysis, the method comprising: introducing vaporized sample compounds behind a supersonic nozzle, expanding the sample compounds with a carrier gas from the supersonic nozzle into a supersonic nozzle vacuum chamber proximate the supersonic nozzle to enable the sample compounds to expand from the supersonic nozzle with carrier gas flow rate greater than 20 ml/min for vibrationally cooling the sample compounds prior to their ionization, continuously ionizing the sample compounds by illuminating them with vacuum ultra-violet photons produced by a continuously operated vacuum ultra-violet photon source to produce ions, transferring said ions for their mass spectrometry analysis with a mass analyzer mounted in a mass analyzer vacuum chamber to obtain mass spectra with dominant molecular ions and fragment ion intensities below 3% of the molecular ion for hydrocarbons.

In accordance with another aspect of the invention, there is provided a method for production of ions for their mass spectrometry analysis, the method comprising: introducing vaporized sample compounds behind a supersonic nozzle, expanding the sample compounds with a carrier gas from the supersonic nozzle into a supersonic nozzle vacuum chamber proximate the supersonic nozzle for vibrationally cooling the sample compounds prior to their ionization, continuously ionizing the sample compounds by illuminating them with vacuum ultra-violet photons produced by a continuously operated vacuum ultra-violet photon source to produce ions, transferring the ions for their mass spectrometry analysis with a quadrupole mass analyzer mounted in a mass analyzer vacuum chamber to obtain mass spectra with dominant molecular ions and fragment ion intensities below 3% of the molecular ion for hydrocarbons.

In accordance with another aspect of the invention, there is provided a method for production of ions for their mass spectrometry analysis, the method comprising: introducing vaporized sample compounds behind a supersonic nozzle, expanding the sample compounds with a carrier gas from the supersonic nozzle into a supersonic nozzle vacuum chamber proximate the supersonic nozzle for vibrationally cooling the sample compounds prior to their ionization, ionizing the sample compounds by either illumination with vacuum ultra-violet photons produced by a continuously operated vacuum ultra-violet photon source or by electrons produced in a fly-through electron ionization ion source, transferring the ions for their mass spectrometry analysis with a mass analyzer mounted in a mass analyzer vacuum chamber to obtain mass spectra from vibrationally cold molecules.

In accordance with another aspect of the invention, there is provided a mass spectrometer system comprising: an inlet port for the introduction of a vaporized sample into a supersonic nozzle for the supersonic expansion of the sample compounds, a carrier gas source, a supersonic nozzle vacuum chamber proximate the supersonic nozzle for expanding the sample compounds from the supersonic nozzle with carrier gas flow rate greater than 20 ml/min for vibrationally cooling the sample compounds, a vacuum ultra-violet photon source configured to produce ions continuously from vibrationally cold sample compounds, an ion optics outlet port configured to transfer ions for their mass spectrometry analysis, and a mass analyzer and ion detector mounted in a mass analyzer vacuum chamber configured to produce photoionization mass spectra from the vibrationally cold sample molecules with dominant molecular ions and fragment ions intensities below 3% of the molecular ion for hydrocarbons.

In accordance with another aspect of the invention, there is provided a mass spectrometer system comprising: an inlet port for the introduction of a vaporized sample into a supersonic nozzle for the supersonic expansion of the sample compounds, a carrier gas source, a supersonic nozzle vacuum chamber proximate to the supersonic nozzle for expanding the sample compounds from the supersonic nozzle for vibrationally cooling the sample compounds, a vacuum ultra-violet photon source configured to produce ions continuously from vibrationally cold sample compounds, an ion optics outlet port configured to transfer ions for their mass spectrometry analysis, and a quadrupole mass analyzer and ion detector mounted in a mass analyzer vacuum chamber configured to produce photoionization mass spectra from the vibrationally cold sample molecules with dominant molecular ions and fragment ions intensities below 3% of the molecular ion for hydrocarbons.

In accordance with another aspect of the invention, there is provided a mass spectrometer system comprising: an inlet port for the introduction of a vaporized sample into a supersonic nozzle for the supersonic expansion of the sample compounds, a carrier gas source, a supersonic nozzle vacuum chamber proximate to the supersonic nozzle for expanding the sample compounds from the supersonic nozzle for vibrationally cooling the sample compounds, a vacuum ultra-violet photon source configured to produce ions continuously from vibrationally cold sample compounds, a fly-through electron ionization ion source to produce ions from vibrationally cold sample compounds that is included in the mass spectrometer system as a second ion source in addition to the photoionization ion source, an ion optics outlet port configured to transfer ions for their mass spectrometry analysis, a mass analyzer and ion detector mounted in a mass analyzer vacuum chamber configured to produce mass spectra from vibrationally cold sample molecules.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF THE INVENTION

The invention is based on an unexpected yet highly useful new observation that photoionization of vibrationally cold molecules in supersonic molecular beams (SMB) produces nearly only molecular ions (under 3% fragment ions) for practically all hydrocarbons in addition to its being the softest ionization method among all known ionization methods and ion sources including field ionization. We adapted a gas chromatograph mass spectrometer (GC-MS) with an electron ionization ion source of vibrationally cold sample molecules in SMB (also named Cold EI [4, 5]) to include a photoionization ion source for the ionization of cold sample compounds in the SMB. This new type of photoionization ion source will be referred to as a Cold PI ion source (PI of cold molecules in SMB).

Figure 1:
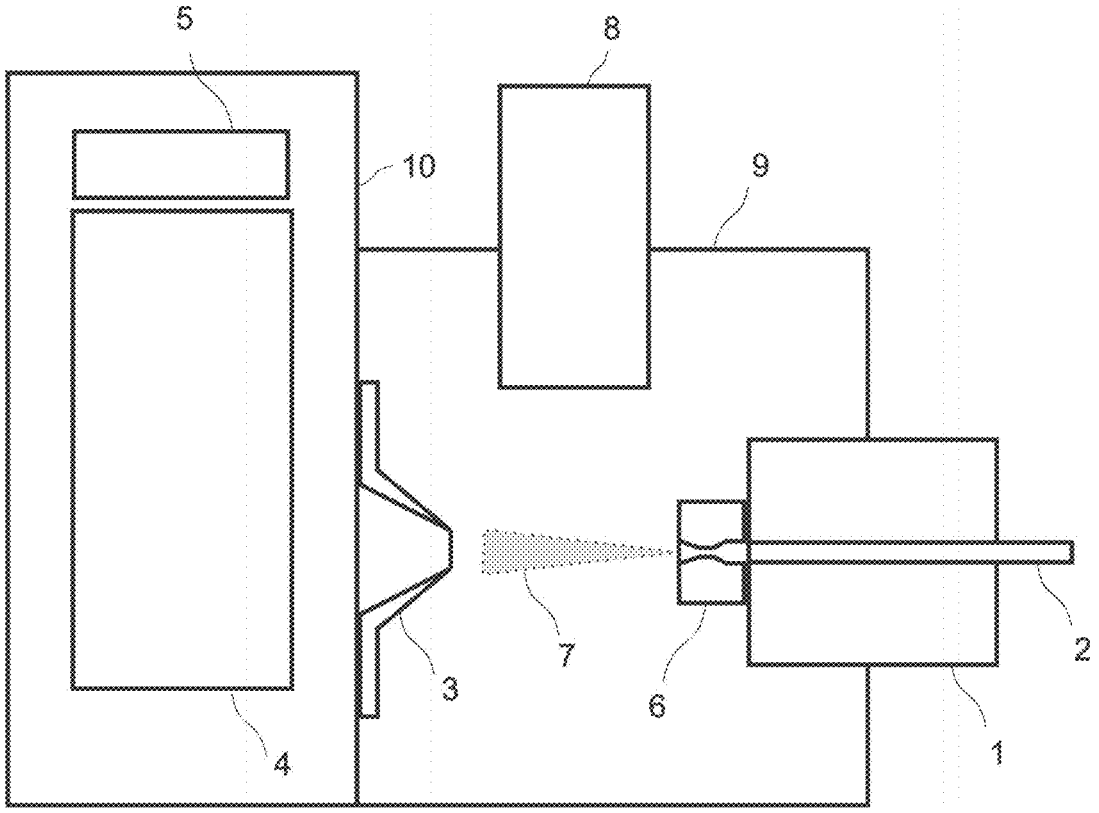
FIG. 1 is a schematic diagram illustrating a mass spectrometer system according to a first embodiment of the present invention.

FIG. 1 is a schematic diagram showing an embodiment of a mass spectrometer system with photoionization ion source for the ionization of vibrationally cold sample compounds in a supersonic molecular beam. The sample is introduced via a sample inlet transfer line 1 that is typically heated and that includes a sample and carrier gas delivery tube 2 while the generated ions are extracted by an ion output device that is typically in the form of a skimmer 3 and are mass analyzed by a mass analyzer 4 and detected by ion detector 5. The sample compounds and carrier gas (combined added make-up gas and column carrier gas) expand into a vacuum chamber via a supersonic nozzle 6 and the expanded free jet that forms a supersonic molecular beam 7 is illuminated by the ionizing vacuum ultra-violet light that is generated from a vacuum ultra-violet light source 8 that is positioned above and perpendicular to the expanded supersonic free jet. The mass spectrometer system with photoionization ion source is pumped by two vacuum pumps that separately pump the supersonic nozzle vacuum chamber 9 and mass analyzer vacuum chamber 10.

Figures 2A, 2B, 2C:
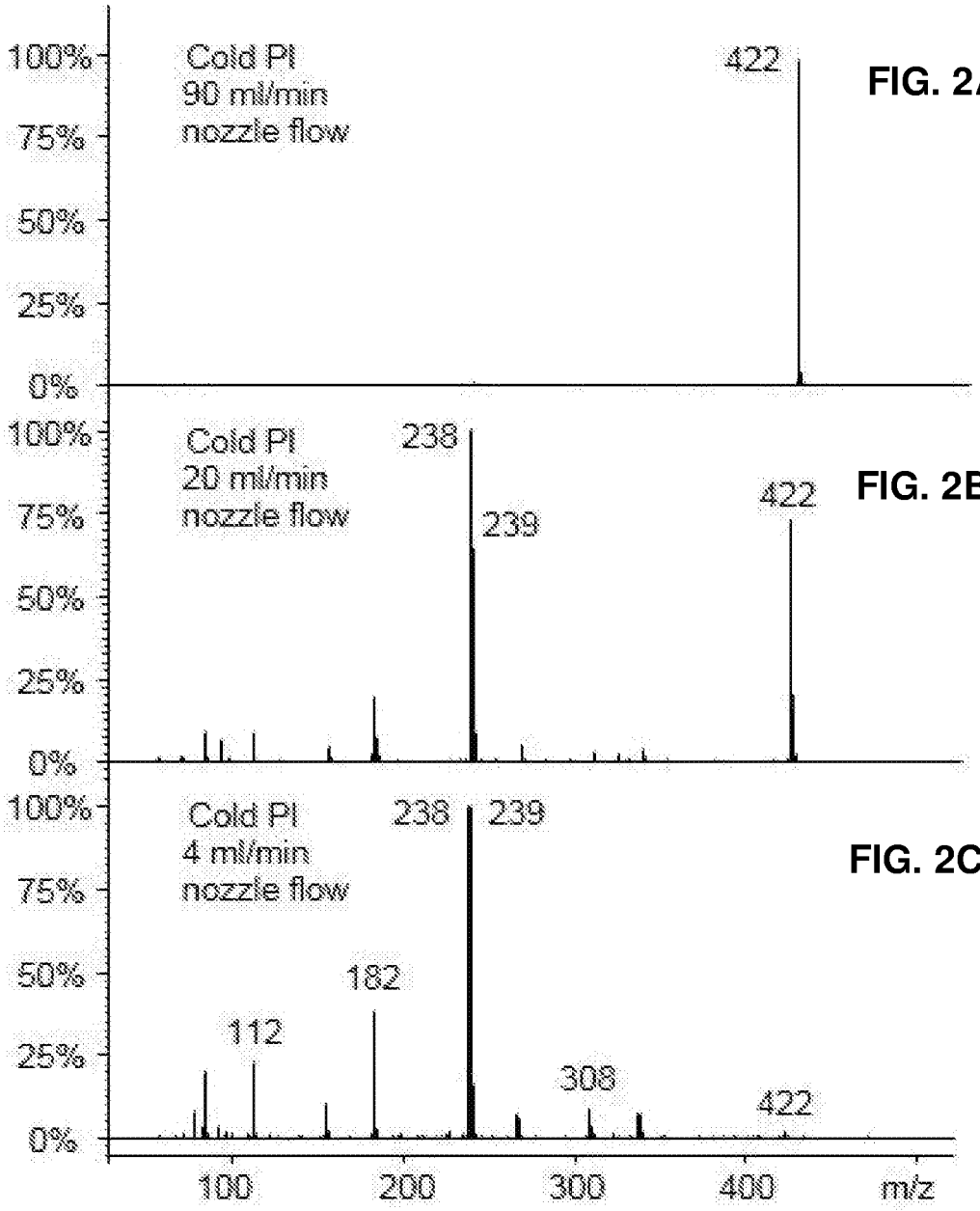
FIGS. 2A-2C illustrate the vibrational cooling effect of supersonic molecular beams on the obtained photoionization mass spectra of squalane ($C_{30}H_{62}$) at varying cooling gas flow rates.

FIG. 2A shows the photoionization mass spectrum of vibrationally cold squalane obtained with 90 ml/min helium carrier cooling gas (make-up and column) at the nozzle. FIG. 2B shows the photoionization mass spectrum of vibrationally cooled squalane obtained with 20 ml/min helium carrier cooling gas (make-up and column) at the nozzle. FIG. 2C shows the photoionization mass spectrum of squalane that was obtained with only 4 ml/min helium carrier gas flow rate (make up and column) that induced only minimal internal vibrational cooling from the supersonic nozzle temperature of 250° C.

These figures show for squalane, which is a highly branched $C_{30}H_{62}$ isoprenoid hydrocarbon, over three orders of magnitude enhancement in the molecular ion relative abundance in Cold PI (photoionization of cold molecules in supersonic molecular beams) versus in standard photoionization of thermal compounds as demonstrated in FIG. 2C. Accordingly, we also show that standard photoionization is not as soft an ionization method as previously perceived [6] for large compounds and does not provide molecular ions only due to their large internal thermal energy. Furthermore, we demonstrate that surprisingly very high supersonic nozzle cooling gas flow rate is required and even at 20 ml/min combined column carried and added make-up helium flow rate the supersonic expansion cooling is insufficient and as demonstrated in FIG. 2B the Cold PI mass spectrum is still dominated by fragment ions.

FIG. 2A shows that we obtained only one fragment ion at about or under 1% relative abundance for squalane (m/z=239) and thus practically only molecular ions are obtained. In addition, we demonstrated over three orders of magnitude SMB cooling effect in comparison with photoionization mass spectrum of thermal squalane in which the molecular ion relative abundance was only 3% (FIG. 2C) and which presents more than ten different fragment ions. Accordingly and as demonstrated in FIG. 2A, we found that Cold PI is even softer than field ionization [1-3] and Cold EI [7] including for squalane itself, thus proved that it is the softest known ionization method. The signal is about 100 times weaker than with Cold EI (electron ionization of cold molecules) but stronger than that of field ionization.

Since squalane is a highly branched hydrocarbon, its molecular ion relatively easily dissociates into fragment ions much more than for linear chain or aromatic hydrocarbons. Accordingly, we found that all other aliphatic (and aromatic) hydrocarbons produced only molecular ions in Cold PI without any observed fragment ions and accordingly practically all compounds in fuels and oils produce only molecular ions.

In contrast, the National Institute of Standards and Technology (NIST) library EI mass spectrum of squalane has a very weak molecular ion with only 0.2% relative abundance while in our experiments with standard EI it was weaker than 0.1%. On the other hand, Cold EI mass spectrum of squalane is highly informative with a combination of abundant molecular ion and structurally informative fragment ions while low electron energy Cold EI attempts to get molecular ion only failed [7]. Thus, in comparison with standard ionization methods Cold PI is the only method that provides practically only molecular ions and thus like field ionization [1-3] it can serve for the analysis of complex oils and petrochemical mixtures that cannot be fully separated by the GC while providing a unified averaged mass spectrum for the whole mixture for the provision of group type information. Consequently, it is useful to have in the same system that has the Cold PI ion source also a Cold EI ion source that can be conveniently placed just after (i.e. downstream of) the skimmer. When the Cold PI ion source is operational, the Cold EI ion source filament is off and its fly-through ion cage serves as a portion of the Cold PI ion transfer optics system while when needed the Cold EI can be operational via a method change without any hardware change since as shown in FIG. 1 the Cold PI light source is off in that case and does not interfere in the SMB path to and downstream of the skimmer. Cold EI provides complementary and supplementary information to Cold PI in the form of structurally informative fragment ions, NIST library searchable mass spectra and good sensitivity. As a result, a mass spectrometry system that includes both Cold PI and Cold EI seems ideal. We note that both Cold EI and Cold PI can share the same sample inlet, supersonic nozzle and its vacuum chamber and mass analyzer thus Cold EI and Cold PI is a new and surprisingly beneficial technology couple.

FIGS. 2A to 2C indicate that the supersonic expansion provides gradual intra molecular vibrational cooling that depends on the supersonic expansion gas flow rate and compound size. As the sample compound size is increased its vibrational cooling becomes increasingly more difficult since in view of the growing mass difference the required number of cooling collisions with Helium is increased while the sample internal heat is also linearly increased with the number of sample compound atoms. In addition, for large compounds the nozzle temperature must be increased to eliminate and/or reduce adsorption time onto its walls and thus the sample internal vibrational energy grows non-linearly and the cooling efficiency is significantly reduced with the sample size. Our solution for such difficult supersonic expansion cooling is in the use of a well-designed shaped nozzle such as with a 100μ channel diameter for 0.8 mm followed by 30° cone for 1 mm and particularly with increased nozzle flow rate of its cooling gas. We found that with such a supersonic nozzle and at above 60 ml/min supersonic expansion gas flow rate, we can obtain below 50K internal vibration temperature for large compounds for which the target is about 30K. However, such increased nozzle flow rate must be paid for by the addition of a differential pumping vacuum chamber and its pump which adds cost and size to the system. We note that as the gas flow rate into a mass spectrometer of GC-MS is increased, its sensitivity is reduced until at above 8 ml/min a differential pumping vacuum chamber with its pump must be added. Similarly, a time of flight MS is typically operated with two vacuum chambers while with added flow rate above 10 ml/min it should include an additional third differentially pumped vacuum chamber or both the sensitivity and mass resolution will decline. As shown in FIG. 2B, at 20 ml/min while there is some cooling effect, it is far from being sufficient for having MS separation capability as needed for fuels and oils analysis. On the other hand, the addition of a differential pumping vacuum chamber for the supersonic nozzle adds surprising additional benefits such as the ability to increase the GC column flow rate and thereby lower the elution temperatures of large compounds thus enabling the analysis of much larger and more thermally labile compounds on the GC-MS scale. Furthermore, LC-MS and liquid flow injection modes can also be combined and uniquely work with Cold PI in view of availability of differential pumping for the supersonic nozzle to enable it to work with high column flow rates. As shown in FIG. 2A our system enables the use of 90 ml/min which is sufficient to reduce the squalane fragment ions to below 1% and we note that even at 60 ml/min the fragment ions relative abundance is about 5% which can too high for certain applications. We found that if we wish to provide the mass analyzer separation power we need to suppress molecular ion fragmentation to below 3% for the vast majority of compounds.

Figure 3:
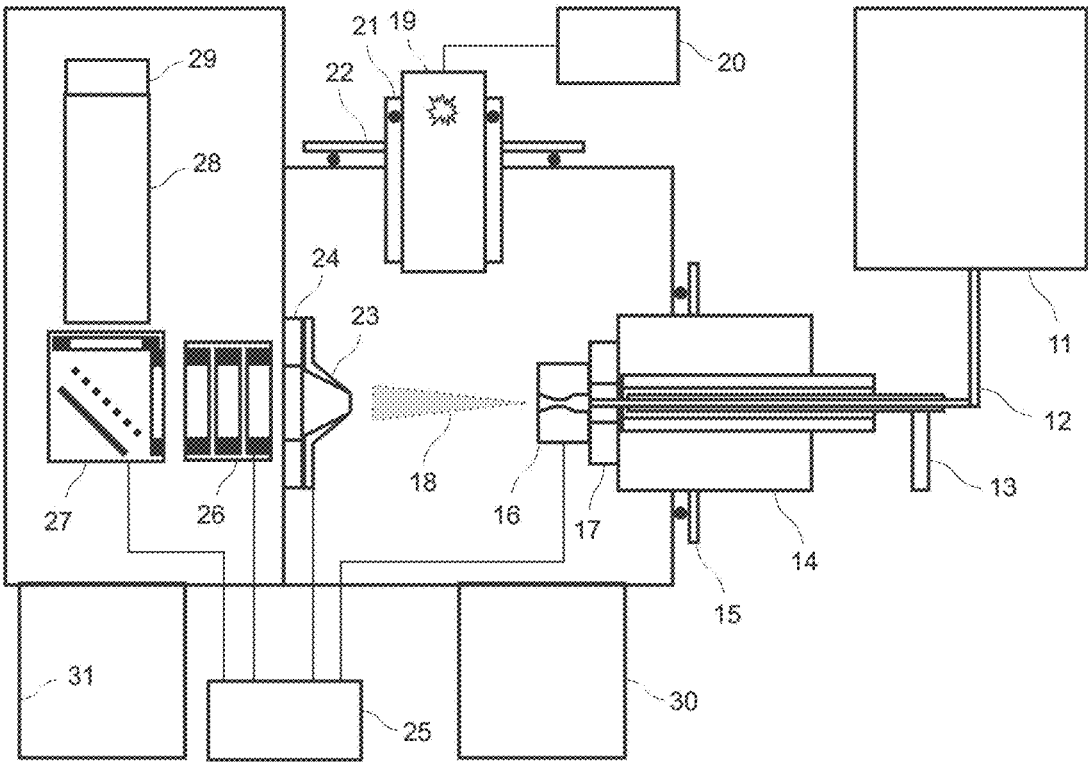
FIG. 3 is a schematic diagram illustrating a mass spectrometer system according to a second embodiment.

FIG. 3 is a schematic diagram of the mass spectrometer system according to an embodiment of the invention with a photoionization ion source of vibrationally cold sample compounds in supersonic molecular beams and further shows various preferred and optional features. The sample compounds are provided from the output of a sample delivery source 11 that is either a gas chromatograph (GC) or a liquid chromatograph (LC) or a flow injection system. Even air can be directly analyzed as Cold PI does not have an oxygen sensitive filament. The sample is delivered in a tube 12 that can be heated and is mixed with make-up gas such as helium that is provided from the make-up gas source 13. The sample compounds and make-up gas (and column carried gas if a GC is used) are transferred via a transfer line 14 that is sealed via a sealing flange 15 and that is typically heated to prevent condensation of the vaporized sample. The transfer line 14 transfers the sample compounds into a supersonic nozzle 16 that is electrically insulated via an insulation element 17 so that the nozzle can be electrically voltage biased. The supersonic nozzle 16 induces supersonic expansion and the formation of supersonic molecular beams (SMB) 18 with vibrationally cold sample molecules in view of the adiabatic expansion of sample compounds with high make-up gas flow rate that improves the supersonic expansion induced vibrational cooling. The vibrationally cold molecules in the SMB are illuminated with ionizing vacuum ultra-violet photons that are generated by vacuum ultra-violet light source 19 that is powered by a power supply 20 and which is housed in a light source housing 21 and is sealed via vacuum sealing element 22. The photoionization produced ions are extracted by the ion exit delivery device 23 that is typically a skimmer with a sharp cone edge that is mounted on an electrical insulation element 24 that enables voltage biasing of the skimmer by a power supply 25 for improved ion extraction. The photo-produced ions are transferred via an ion optics element 26 that can include a Cold EI ion source and an ion mirror 27 into the mass spectrometer mass analyzer 28 that can be a quadrupole mass analyzer or any other type of mass analyzer and the ions are detected after mass analysis by ion detector 29. The mass spectrometer system is pumped by a vacuum pump 30 at the supersonic molecular beam expansion vacuum chamber and typically by another pump 31 at the mass analyzer vacuum chamber. The two pumps can be integrated into a single split turbo molecular pump. It is noted that the power supply 25 serves for the electrical biasing of the nozzle, skimmer and ion optics elements 26 and 27 while it can be integrated with or separated from the vacuum ultra-violet light source power supply 20.

The Cold PI mass spectra of all hydrocarbons (aliphatic and aromatic) were found to exhibit only molecular ions (and their isotopomers) with no fragment ions in their Cold PI mass spectra, this feature being unique to Cold PI. On the other hand, alcohols such as octanol and certain phthalates such as dioctylphthalate exhibit a combination of the molecular ion and fragment ions. It is noted that a similar type of fragmentation is exhibited in field ionization [3] since in alcohols the elimination of the water molecule by the molecular ion is energetically favorable since it involves the breaking of C—OH and C—H bonds while forming OH—H bond and C=C double bond. Moreover, the ionization potential of the olefin is lower than of the alcohol and thus very little or no energy is required for this fragmentation.

We explored the supersonic expansion induced vibrational cooling among several groups of compounds and their size effect and found that in general we can separate sample compounds into three groups of: a) Small molecules such as benzene with 12 atoms in which the internal heat capacity is small. For these compounds there is little or no effect of vibrational cooling in SMB on the enhancement of the molecular ion and the mass spectra of PI and Cold PI are similar and are practically the same with some minor cooling effect for hydrocarbons; b) Intermediate size compounds with number of atoms between 20 and 40. For these compounds Cold PI exhibits noticeable enhanced molecular ions compared with PI of thermal compounds; c) Large molecules with over 40 atoms. For this group of compounds their internal heat capacity is large enough to induce significant molecular ion fragmentation in photoionization of thermal molecules and thus Cold PI results in a major enhancement of the molecular ions and a corresponding reduction of fragment ions abundances. Squalane with 92 atoms was given in FIGS. 2A-2C as an example for this large effect which is universal although its magnitude can vary among various groups of compounds and it strongly depends on the vibrational cooling efficiency which can require the use of shaped supersonic nozzle, high supersonic nozzle flow rate and the addition of a supersonic nozzle vacuum chamber and its related vacuum pump.

This represents a significant and unexpected improvement over Mitschke et al. [8] from which, as noted above, it may be concluded that photo-induced fragmentation is inherent and cannot be eliminated by cooling alone. In addition, it could be understood from Mitschke et al. that if for a relatively small and simple molecule like n-nonane having only 29 atoms the cooling was insufficient to fully eliminate molecular ion fragmentation, then a fortiori molecular ion fragmentation should be even more pronounced for larger compounds with much higher thermal heat capacities and which are much harder to cool down in view of the larger mass difference between the sample compound and the cooling helium mass to say nothing of the hotter supersonic nozzle required to eliminate lengthy sample adsorption cycles. Thus, Mitschke et al. provide no incentive to use a photo-ionization ion source of vibrationally cold sample compounds in supersonic molecular beams. Furthermore, Mitschke et al. use a time of flight mass spectrometer having a limitation of 10 ml/min added flow rate. There is no suggestion or even to attempt to eliminate the residual fragmentation by use of an additional vacuum pump to the supersonic nozzle area. This renders the effectiveness of the method and mass spectrometer system according to the present invention all the more surprising and attractive.

Cold PI works surprisingly very well with a Deuterium discharge lamp as the vacuum ultra-violet photoionization light source and it was also tested with a Krypton lamp. In addition, an intense windowless vacuum ultra-violet light source can also be used based on discharge in flowing gases but with added system complexity. While lasers with multiphoton ionization of compounds in SMB can also serve for ionization, their response is highly selective and thus they are not very useful in analytical mass spectrometry such as in the analysis of fuels. Lasers with single photon ionization as used by Mitschke et al. can serve well for ionization but: A) They add significant cost, size and complexity to the system; B) VUV lasers must be pulsed and thus require expensive and bulky time of flight mass analyzers while precluding the use of quadrupole mass analyzers. Thus, continuously operated photoionization lamps with their broad emission spectrum are the most suitable light source for Cold PI mass spectrometry analysis.

Currently used field ionization sources require high voltage biasing of their field emitting tips. Thus, they require the use of expensive time of flight or magnetic sectors mass analyzers. Cold PI on the other hand does not require any high voltage (high electric field strength in the ionization area) and thus can be used in combination with any type of mass analyzer including the low cost and widely used single quadrupole that is the current GC-MS industry standard mass analyzer. The low cost of quadrupole MS, its small benchtop footprint and its ease of operation and widespread availability is an important benefit of Cold PI versus FI and versus any pulsed laser based ionization method. With pulsed lasers (and any other pulsed ion sources) quadrupole mass analyzers cannot scan fast enough since in every laser pulse the quadrupole MS can change its transmitted mass by only 0.1 amu and typically transmit mass spectral range of only 0.6 amu. Thus, the combination of pulsed lasers and quadrupole MS is ruled-out and mostly expensive time-of-flight mass analyzers are required. Pulsed lasers are used for in-vacuum photoionization such as by Mitschke et al. [8] since they are far more intense than lamps. In photoionization of thermal sample compounds the sample molecules at the PI ion source are ten times slower than in SMB plus they are adsorbed and desorbed from the PI ion source walls about 40-100 times and thus it may be surmised that PI with lamps should generate 400-1000 times lower signal in Cold PI than in PI of thermal compounds which implies that the use of lasers is essential for obtaining sufficient sensitivity. However, as demonstrated in FIG. 2 and FIG. 4 below, sufficiently good sensitivity was surprisingly achieved with a simple commercially available continuously operated deuterium VUV lamp (Hamamatsu, Japan) which not only eliminates the high price (and complexity) of pulsed VUV lasers but also enables the use of the GC-MS industry standard quadrupole mass analyzers. Possibly the high sample density in the supersonic expansion near the supersonic nozzle compensates in part for the assumed lower ion signal in Cold PI versus in thermal photoionization. The use of Cold PI and quadrupole mass analyzer (unlike with pulsed lasers) further requires the use of a curved extracted ion path to prevent direct line of sight path of the VUV radiation and the ion detector that could generate high noise level. We used a 90° ion mirror as a part of the ion optics but a curved RF-only quadruple can be similarly used. We consider the ability to use a continuous VUV lamp and quadrupole mass analyzer to be a major benefit of the mass spectrometer and method according to the invention.

Helium is the GC-MS industry standard carrier gas that combines fast analysis with chemical inertness. Thus, it was tested with Cold EI to produce very good vibrational cooling in SMB and accordingly it is the first make-up gas of choice for Cold PI. However, hydrogen, nitrogen and argon can also be used, each having some benefits and drawbacks. For example, nitrogen and/or argon are an order of magnitude more effective than helium in inducing vibrational cooling and thus require much less make-up cooling gas flow rate. On the other hand their heavier molecular or atomic weight implies that the GC separation is slower with them and their use can also result in greater degree of collision induced dissociation than helium thus favoring the use of helium. Hydrogen, can be used but it is a reactive gas that requires special safety considerations. On the other hand, solvent vapor such as methanol, acetonitrile, water, cyclohexane etc. can be added to helium make up gas or serve as the cooling gas by itself to improve its vibrational cooling and in Cold PI that operates with LC-MS such solvent vapor in inherently exhibited. In fact, Cold PI is very useful in combination with LC-MS because in view of its feature of exhibiting substantially only molecular ions, lengthy LC-MS can be replaced with Cold PI with fast flow injection MS while LC-MS of complex matrices that are not fully separated is simplified via the added separation dimension of the MS in the case of having only molecular ions. Currently, LC-MS is operated mostly with electrospray ionization and/or atmospheric pressure chemical ionization or atmospheric pressure photoionization. All these three ionization methods occur with atmospheric pressure ion-molecule reactions and thus often exhibit fragment ions, protonated molecular ions, adduct ions, dimers and extensive mass spectral background that combined preclude their use in flow injection analysis instead of longer LC-MS analysis, unlike in Cold PI. In FIG. 2 we used 90 ml/min helium make up and column flow rate to reduce the squalane fragment ions intensity to below 1% while at 4 ml/min the molecular ion abundance was about 3%. Clearly the cooling is a gradual effect and if for any reason some fragments are desirable the user can control the degree of fragmentation via the amount of cooling make up gas used.

An experimental difficulty in Cold PI of residual electron ionization was encountered that interfered with the obtained Cold PI mass spectra in that the photoionization process also produced electrons from the vacuum chamber metal walls via the photo-electric effect. These electrons were accelerated toward positively biased surfaces such as the magnesium fluoride PI lamp window that was charged to a high voltage due to the lamp internal discharge. In order to suppress this parasitic electron ionization process that resulted in having mass spectra of the combination of Cold PI and Cold EI with undesirable fragment ions, a grounded 90% transmission gold plated mesh was disposed in front of the PI lamp on its mount.

Photoionization can be performed anywhere downstream of the supersonic free jet expansion and the formation of SMB and before the mass analyzer. However, the optimal place in terms of signal strength is between the nozzle and skimmer which is inside the supersonic nozzle vacuum chamber that is typically pumped by a 250 L/s turbo molecular pump (or another pump). The vibrational cooling typically ends after 30 nozzle diameters which is about 3 mm from the supersonic nozzle and thus for a typical 12 mm nozzle-skimmer distance the VUV lamp can illuminate the expanded sample compounds at about 4-5 mm from the skimmer. Both the nozzle and skimmer are voltage biased to effectively attract ions to the skimmer and further transmit them for mass analysis. However, since the pressure at the supersonic nozzle vacuum chamber is relatively high, placing the VUV lamp downstream of the skimmer at the MS vacuum chamber could be beneficial for the reduction of residual collision induced dissociation.

Another problem that we had to address was undesirable collision induced dissociation (CID) after the photoionization and before the skimmer. We managed to reduce this effect to an acceptable level as demonstrated in FIG. 2 for squalane in which the magnitude of the m/z=239 fragment was under 1%, which is lower than the fragment ions that are exhibited in field ionization. We found that the addition of a separately voltage biased pre-skimmer plate in front of (i.e. upstream of) the skimmer and using low bias voltages on the nozzle and skimmer helped to reduce electrical fields near the skimmer thereby suppressing CID effects.

Figures 4A, 4B, 4C:
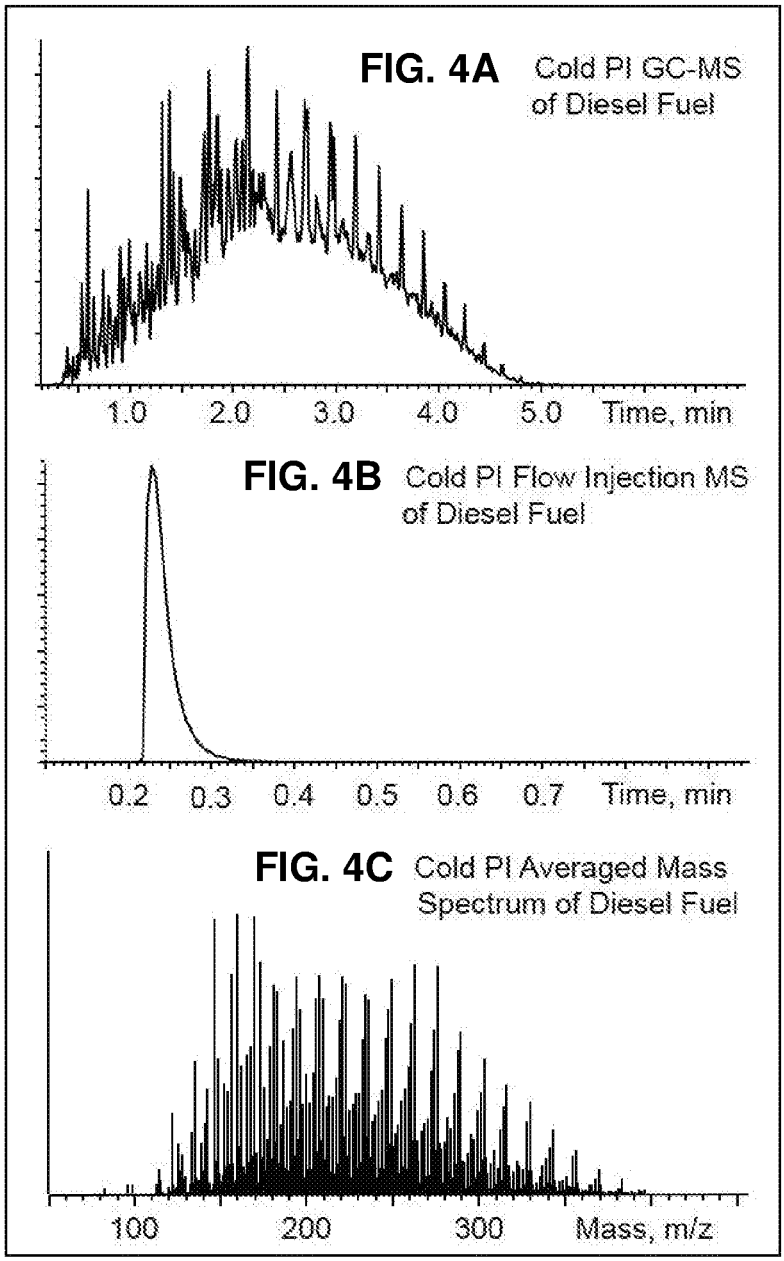
FIGS. 4A-4C show GC-MS with Cold PI and flow injection Cold PI analysis of Diesel fuel and the resulting averaged Cold PI mass spectrum under varying conditions using the system according to the invention.

FIG. 4A shows the GC-MS with Cold PI total ion mass chromatogram of local Israeli Diesel fuel. FIG. 4B shows the flow injection analysis of this same Diesel fuel when the column was maintained at 300° C. and FIG. 4C shows the averaged Cold PI mass spectrum of the Diesel fuel obtained with the flow injection analysis.

An important feature of Cold PI is that it is fully compatible with GC separation and its related flow of capillary column carrier gas as shown in FIG. 4A in which Diesel fuel is separated and generates a Cold PI total ion mass chromatogram. Despite the relative weakness of the Cold PI signal (versus electron ionization) its noise is practically zero thus it provides useful information. Furthermore, unlike in FI there is no Cold PI ion source peak tailing since the Cold PI ion source is a fly-through type without sample contact with the ion source walls or any other surface. Accordingly, it can be used for very large hydrocarbons with an estimated size limit in access of 70 carbon atoms.

FIG. 4B also demonstrates that we can employ Cold PI for obtaining ultra-fast flow injection analysis of fuels such as Diesel fuel and oils. By such means, cold PI mass spectra characterization of complex hydrocarbon mixtures can be obtained in less than 20 seconds as demonstrated in FIG. 4B for Diesel fuel. A 15 m GC column was used and was maintained at high GC oven temperatures (300° C.). Such a high temperature GC column oven practically eliminated sample retention and a column flow rate of 8 ml/min was used to reduce the analysis time. Alternatively, a short transfer-line capillary can serve for fast flow injection analysis by Cold PI-MS. We are not aware of any prior art of flow injection analysis with FI or PI. In FIG. 4C the averaged Cold PI mass spectrum of Diesel fuel is shown as obtained from mass spectral averaging of the flow injection total ion mass chromatogram trace. As demonstrated, each family (group) of hydrocarbon size clearly exhibits its various degrees of unsaturation while the saturated hydrocarbons are the most abundant.

In addition and as mentioned above, we found that we can use Cold PI for the detection of liquid chromatography and as a result convert lengthy LC-MS into either much faster LC-MS with overlapping peaks or flow injection MS in which the mass spectrometer serves for the separation. In the use of Cold PI with LC-MS we had to vaporize the sample from its flowing solution via pneumatic nebulization and thermal vaporization, as has been done in electron ionization LC-MS with Cold EI as described by Seemann et al. [9].

In conclusion, a new and useful mass spectrometer system with Cold PI ion source is described for improved sample analysis. The new Cold PI ion source provides enhanced molecular ions including molecular ion only in its mass spectra of hydrocarbons and thus enables their analysis by the mass spectrometer itself without gas chromatography separation. Cold PI is uniquely compatible also with flow injection mass spectrometry and liquid chromatography mass spectrometry analysis. Cold PI can be operated with a quadrupole mass analyzer for low cost and improved ease of use in a mass spectrometer system that can also include a Cold EI ion source for improved flexibility.

The description of the above embodiments is not intended to be limiting, the scope of protection being provided only by the appended claims.

In particular it should be noted that features that are described with reference to one or more embodiments are described by way of example rather than by way of limitation to those embodiments. Thus, unless stated otherwise or unless particular combinations are clearly inadmissible, optional features that are described with reference to only some embodiments are assumed to be likewise applicable to all other embodiments also.

The invention claimed is:

1. A method for production of ions for their mass spectrometry analysis, the method comprising:

introducing vaporized sample compounds behind a supersonic nozzle, wherein at least a portion of said sample compounds have more than 40 atoms;

expanding the sample compounds with a carrier gas from the supersonic nozzle into a supersonic nozzle vacuum chamber proximate the supersonic nozzle to enable the sample compounds to expand from the supersonic nozzle with carrier gas flow rate greater than 20 ml/min for vibrationally cooling the sample compounds prior to their ionization;

separately pumping the supersonic nozzle vacuum chamber and the mass analyzer vacuum chamber so as to allow increased flow rate of cooling gas through the supersonic nozzle and thereby improved cooling of the sample compounds;

continuously ionizing the sample compounds by illuminating them with vacuum ultra-violet photons produced by a continuously operated vacuum ultra-violet photon source to produce ions; and transferring said ions for their mass spectrometry analysis with a mass analyzer mounted in a mass analyzer vacuum chamber to obtain mass spectra with dominant molecular ions and fragment ion intensities below 3% of the molecular ion for hydrocarbons.

2. The method according to claim 1 in which the vacuum ultra-violet light source is a lamp that enables single-photon ionization.

3. The method according to claim 1 in which the mass spectrometry analysis is performed with a quadrupole mass analyzer.

4. The method according to claim 1 in which the carrier gas includes vaporized solvent molecules.

5. The method according to claim 1 in which the ions are produced by photoionization downstream of a skimmer.

6. The method according to claim 1, further including separating molecules of the sample compounds along a gas chromatograph column prior to introduction to the supersonic nozzle.

7. The method according to claim 1, further including separating molecules of the sample compounds along a liquid chromatograph column prior to introduction to the supersonic nozzle.

8. The method according to claim 1 in which the sample compounds are introduced via flow injection of a liquid that contains the sample compounds into a heated gas chromatograph column prior to its introduction as vaporized sample compounds behind a supersonic nozzle.

9. A method for production of ions for their mass spectrometry analysis, the method comprising:

introducing vaporized sample compounds behind a supersonic nozzle;

expanding the sample compounds with a carrier gas from the supersonic nozzle into a supersonic nozzle vacuum chamber proximate the supersonic nozzle for vibrationally cooling the sample compounds prior to their ionization;

separately pumping the supersonic nozzle vacuum chamber and the mass analyzer vacuum chamber so as to allow increased flow rate of cooling gas through the supersonic nozzle and thereby improved cooling of the sample compounds;

continuously ionizing the sample compounds by illuminating them with vacuum ultra-violet photons produced by a continuously operated vacuum ultra-violet photon source to produce ions; and transferring the ions for their mass spectrometry analysis with a quadrupole mass analyzer mounted in a mass analyzer vacuum chamber to obtain mass spectra with dominant molecular ions and fragment ion intensities below 3% of the molecular ion for hydrocarbons.

10. The method according to claim 9 in which the ions are produced upstream of a skimmer and are transmitted to the mass analyzer via the skimmer.

11. The method according to claim 9 in which the mass spectrometer further includes a fly-through type electron ionization ion source for the ionization of cold molecules in supersonic molecular beams.

12. The method according to claim 9 when used for mass spectrometry analysis of sample compounds at least a portion of which have more than 40 atoms.

13. The method according to claim 9 in which the sample compounds are introduced via flow injection of a liquid that contains the sample compounds into a heated gas chromatograph column prior to its introduction as vaporized sample compounds behind a supersonic nozzle.

14. A method for production of ions for their mass spectrometry analysis, the method comprising:

introducing vaporized sample compounds behind a supersonic nozzle;

expanding the sample compounds with a carrier gas from the supersonic nozzle into a supersonic nozzle vacuum chamber proximate the supersonic nozzle for vibrationally cooling the sample compounds prior to their ionization;

ionizing the sample compounds by either illumination with vacuum ultra-violet photons produced by a continuously operated vacuum ultra-violet photon source or by electrons produced in a fly-through electron ionization ion source in a mass spectrometer system that contains both electron ionization and photoionization ion sources;

separately pumping the supersonic nozzle vacuum chamber and the mass analyzer vacuum chamber so as to allow increased flow rate of cooling gas through the supersonic nozzle and thereby improved cooling of the sample compounds; and transferring the ions for their mass spectrometry analysis with a mass analyzer mounted in a mass analyzer vacuum chamber to obtain mass spectra from vibrationally cold molecules.

15. The method according to claim 14 when used for mass spectrometry analysis of sample compounds at least a portion of which have more than 40 atoms.

16. The method according to claim 14 in which the sample compounds are introduced via flow injection of a liquid that contains the sample compounds into a heated gas chromatograph column prior to its introduction as vaporized sample compounds behind a supersonic nozzle.

17. A mass spectrometer system comprising:

an inlet port for the introduction of a vaporized sample into a supersonic nozzle for the supersonic expansion of sample compounds at least a portion of which have more than 40 atoms, a carrier gas source, a supersonic nozzle vacuum chamber proximate the supersonic nozzle for expanding the sample compounds from the supersonic nozzle with carrier gas flow rate greater than 20 ml/min for vibrationally cooling the sample compounds, a vacuum ultra-violet photon source configured to produce ions continuously from vibrationally cold sample compounds, an ion optics outlet port configured to transfer ions for their mass spectrometry analysis, a mass analyzer and ion detector mounted in a mass analyzer vacuum chamber configured to produce photoionization mass spectra from the vibrationally cold sample molecules with dominant molecular ions and fragment ions intensities below 3% of the molecular ion for hydrocarbons; and respective vacuum pumps for separately pumping the supersonic nozzle vacuum chamber and the mass analyzer vacuum chamber so as to allow increased flow rate of cooling gas through the supersonic nozzle thereby improved cooling of the sample compounds.

18. The mass spectrometer system according to claim 17, wherein the supersonic nozzle is shaped with a channel and cone to produce a supersonic molecular beam with vibrationally cold sample molecules by their expansion into a vacuum chamber through the supersonic nozzle, the nozzle being configured to improve vibrational cooling of the sample per given expanding gas flow rate.

19. The mass spectrometer system according to claim 17, wherein the vacuum ultra-violet light source is a continuously operated lamp that enables single-photon ionization.

20. The mass spectrometer system according to claim 17, wherein the mass analyzer is a quadrupole mass analyzer.

21. The mass spectrometer system according to claim 17, wherein the supersonic cooling gas includes vaporized solvent molecules.

22. The mass spectrometer system according to claim 17, wherein the vacuum ultra-violet lamp is shielded by a mesh to eliminate ionization by photo produced electrons.

23. The mass spectrometer system according to claim 17, further including a skimmer upstream of the mass analyzer.

24. The mass spectrometer system according to claim 17, further including a gas chromatograph upstream of the supersonic nozzle for gas chromatography separation of molecules in the sample prior to introduction to the supersonic nozzle.

25. A mass spectrometer system comprising:

an inlet port for the introduction of a vaporized sample into a supersonic nozzle for the supersonic expansion of the sample compounds, a carrier gas source, a supersonic nozzle vacuum chamber proximate to the supersonic nozzle for expanding the sample compounds from the supersonic nozzle for vibrationally cooling the sample compounds, a vacuum ultra-violet photon source configured to produce ions continuously from vibrationally cold sample compounds, an ion optics outlet port configured to transfer ions for their mass spectrometry analysis, a quadrupole mass analyzer and ion detector mounted in a mass analyzer vacuum chamber configured to produce photoionization mass spectra from the vibrationally cold sample molecules with dominant molecular ions and fragment ions intensities below 3% of the molecular ion for hydrocarbons; and respective vacuum pumps for separately pumping the supersonic nozzle vacuum chamber and the mass analyzer vacuum chamber so as to allow increased flow rate of cooling gas through the supersonic nozzle thereby improved cooling of the sample compounds.

26. The mass spectrometer system according to claim 25, wherein the vacuum ultra-violet photons are produced by a Deuterium or Krypton or flowing gas discharge lamp.

27. The mass spectrometer system according to claim 25, further including a fly-through type electron ionization ion source for the electron ionization of the vibrationally cooled molecules.

28. The mass spectrometer system according to claim 25, further including a liquid chromatograph upstream of the supersonic nozzle for liquid chromatography separation of molecules in the sample prior to introduction to the supersonic nozzle.

29. The mass spectrometer system according to claim 25, further including a flow injection injector for introducing the sample compounds via flow injection of a liquid that contains the sample into a heated gas chromatograph column prior to its introduction as vaporized sample compounds behind a supersonic nozzle.

30. A mass spectrometer system comprising:

an inlet port for the introduction of a vaporized sample into a supersonic nozzle for the supersonic expansion of the sample compounds, a carrier gas source, a supersonic nozzle vacuum chamber proximate to the supersonic nozzle for expanding the sample compounds from the supersonic nozzle for vibrationally cooling the sample compounds, a vacuum ultra-violet photon source configured to produce ions continuously from vibrationally cold sample compounds, a fly-through electron ionization ion source to produce ions from vibrationally cold sample compounds that is included in the mass spectrometer system as a second ion source in addition to the photoionization ion source, an ion optics outlet port configured to transfer ions for their mass spectrometry analysis, a mass analyzer and ion detector mounted in a mass analyzer vacuum chamber configured to produce mass spectra from vibrationally cold sample molecules; and respective vacuum pumps for separately pumping the supersonic nozzle vacuum chamber and the mass analyzer vacuum chamber.

* * * * *